US008211249B2

(12) United States Patent
Sakai et al.

(10) Patent No.: US 8,211,249 B2
(45) Date of Patent: Jul. 3, 2012

(54) COPPER BASE ROLLED ALLOY AND MANUFACTURING METHOD THEREFOR

(75) Inventors: Tetsuo Sakai, Suita (JP); Naokuni Muramatsu, Nagoya (JP); Koki Chiba, Kawaguchi (JP); Naoki Yamagami, Yokohama (JP)

(73) Assignees: NGK Insulators, Ltd., Nagoya (JP); Osaka University, Suita-Shi (JP)

( * ) Notice: Subject to any disclaimer, the term of this patent is extended or adjusted under 35 U.S.C. 154(b) by 783 days.

(21) Appl. No.: 12/342,613

(22) Filed: Dec. 23, 2008

(65) Prior Publication Data

US 2009/0165899 A1 Jul. 2, 2009

Related U.S. Application Data

(63) Continuation of application No. PCT/JP2007/062378, filed on Jun. 20, 2007.

(30) Foreign Application Priority Data

Jun. 23, 2006 (JP) ..... 2006-174419

(51) Int. Cl.
*C12Q 1/68* (2006.01)
*C22F 1/08* (2006.01)

(52) U.S. Cl. ..... 148/679; 148/680; 148/681; 148/682; 148/683; 148/684; 148/685; 148/686

(58) Field of Classification Search ..... 148/679–686
See application file for complete search history.

(56) References Cited

U.S. PATENT DOCUMENTS

| | | | | |
|---|---|---|---|---|
| 4,067,750 | A * | 1/1978 | Mravic et al. | 148/554 |
| 2004/0234412 | A1 | 11/2004 | Oishi et al. | |
| 2005/0121320 | A1 | 6/2005 | Okabe et al. | |
| 2006/0045790 | A1 | 3/2006 | Hatakeyama | |

FOREIGN PATENT DOCUMENTS

| | | | |
|---|---|---|---|
| JP | 2001-152303 | A1 | 6/2001 |
| JP | 2001-244400 | A1 | 9/2001 |
| JP | 2001-262224 | A1 | 9/2001 |
| JP | 2006-063431 | A1 | 3/2006 |
| WO | 03/064722 | A1 | 8/2003 |
| WO | 2004/022805 | A1 | 3/2004 |

OTHER PUBLICATIONS

PH. Lequeu et al., "*Modeling of the Plastic Anisotropy of Textured Sheet*," Metallurgical Transactions A, vol. 19A, Jan. 1988, pp. 105-120.

Isao Gokyu et al., "*Relation Between Crystallographic Orientation and Deep Drawing Unit*," J. Japan Inst. Metals, 32 (1968), pp. 742-747.

(Continued)

*Primary Examiner* — Sikyin Ip
(74) *Attorney, Agent, or Firm* — Burr & Brown

(57) ABSTRACT

A copper base rolled alloy has a copper base alloy composition containing 0.05 percent by mass or more, and 10 percent by mass or less of at least one type of element selected from Be, Mg, Al, Si, P, Ti, Cr, Mn, Fe, Co, Ni, Zr and Sn, wherein the X-ray diffraction intensity ratio I(111)/I(200) where I(hkl) is the X-ray diffraction intensity from (hkl)plane measured with respect to a rolled surface is 2.0 or more.

6 Claims, 3 Drawing Sheets

OTHER PUBLICATIONS

Tetsuo Sakai et al, "*Through-Thickness Variation of Microstructure and Texture in High Speed Hot Rolling of Aluminum and Aluminum Alloy Sheet*," Proceedings of the Second International Conference on Light Materials for Transportation Systems (LiMAT-2001), Pusan, Korea, May 6-10, 2001, pp. 311-316.

Tetsuo Sakai et al, "*Control of Through-Thickness Shear Texture by Asymmetric Rolling*," Materials Science Forum vol. 396-402 (2002), pp. 309-314.

Junya Watanabe et al., "*Texture of Microstructure Control of Cu and Cu-Zn Alloy by Differential Speed Rolling*," Journal of the JRICu, vol. 44, No. 1 (2005), pp. 73-78.

* cited by examiner

COPPER BASE ROLLED ALLOY AND MANUFACTURING METHOD THEREFOR

FIELD OF THE INVENTION

The present invention relates to a copper base rolled alloy and a manufacturing method therefor.

BACKGROUND OF THE INVENTION

Various copper alloys have excellent electrical conductivity and excellent workability and, therefore, have been used for various electronic components and mechanical components. Regarding such copper alloys as well, still more improvement in workability has been required to make products more compact and extend the functionality. In order to work a copper alloy material into a fine member with high precision, it is desired that the copper alloy material is made into a rolled alloy by conducting rolling in such a way as to become a state in which good workability is ensured. For example, it is known that (111) orientation in parallel to a sheet surface, that is, development of a <111>//ND texture is important for improving the press formability and workability in bending (Non-Patent Documents 1 and 2). Regarding metals, e.g., aluminum and copper, having a face centered cubic (FCC) structure, it is known that this <111>//ND component is not developed by a common rolling and annealing method but is developed by shear deformation. For example, <111>//ND is developed in the vicinity of the surface of aluminum rolled under a high friction (Non-Patent Document 3).

It is believed that differential speed rolling is useful for development of a <111>//ND texture throughout the sheet thickness, and the usefulness for an aluminum alloy sheet has been reported (Non-Patent Document 4). On the other hand, it has been reported that when oxygen-free copper and brass, which is a copper-zinc alloy, are subjected to working through differential speed rolling, a <111>//ND texture is formed throughout the sheet thickness (Non-Patent Document 5).

Non-Patent Document 1: Ph. Lequeu and J. J. Jonas: Metallugical transactions A, 19A (1988), 105-120

Non-Patent Document 2: I. Gokyu, K. Suzuki, and C. Fujikura, J. Japan Inst. Metals, 32 (1968), 742-747

Non-Patent Document 3: T. Sakai, S. H. Lee and Y. Saito, Proc. LiMAT2001, Busan, Korea (2001), 311-316

Non-Patent Document 4: T. Sakai, K. Yoneda, Y. Saito, Material Science Forum, 396-412 (2002), 309-314

Non-Patent Document 5: T. Sakai, J. Watanabe, N. Iwamoto and H. Utsunomiya, Journal of the JRICu, Vol. 44 No. 1 (2005), 73-78

SUMMARY OF THE INVENTION

As described above, regarding pure copper and brass, copper alloys having a rolling texture in which <111>//ND orientation has developed are obtained through the differential speed rolling. However, according to research conducted by the present inventors, it was made clear that in the case where a copper alloy was rolled under high friction, <111>//ND was developed in the vicinity of the surface, but the <111>//ND texture formed once was reduced significantly by a solution treatment. Consequently, other copper alloys, in particular, a copper alloy having a rolling texture in which the <111>//ND orientation has developed even after a heat treatment, e.g., the solution treatment, in a temperature range of 700° C. to 1,000° C. have not been obtained up to now.

Since a shear texture formed through shear strain is also a deformation texture, it is predicted that the shear texture is influenced by the alloy components. However, the structure of the shear texture formed from alloy components in the copper alloy and the state of change due to the following working of the shear texture formed once cannot be predicted at all.

Accordingly, it is an object of the present invention to provide a copper base rolled alloy having excellent workability and a manufacturing method therefor. Furthermore, it is another object of the present invention to provide a copper base rolled alloy having excellent workability and strength and a manufacturing method therefor. In addition, it is another object of the present invention to provide a copper base rolled alloy in which a <111>//ND texture has developed and a manufacturing method therefor. Moreover, it is another object of the present invention to provide a precipitation hardening copper base rolled alloy having a <111>//ND texture and a manufacturing method therefor.

In order to solve the above-described problems, the present inventors conducted a variety of studies. As a result, it was found that in the case where a copper alloy containing alloy components in a predetermined range was subjected to a non-lubricating rolling, a <111>//ND texture, which is a texture having good workability, was able to be developed and, in addition, this rolling texture was able to be maintained even after a solution treatment. Consequently, the present invention has been made. That is, according to the present invention, the following means are provided.

(1) A copper base rolled alloy having:

a copper base alloy composition containing 0.05 percent by mass or more, and 10 percent by mass or less of at least one type of element selected from Be, Mg, Al, Si, P, Ti, Cr, Mn, Fe, Co, Ni, Zr, and Sn, wherein the X-ray diffraction intensity ratio I(111)/I(200) where I(hkl) is the X-ray diffraction intensity from (hkl)plane measured with respect to a rolled surface is 2.0 or more.

(2) The copper base rolled alloy according to the item (1), wherein the above-described element is at least one type selected from Be, Si, Ti, and Ni.

(3) The copper base rolled alloy according to the item (1) or the item (2), wherein P at a concentration more than or equal to the concentration of incidental impurities is not contained.

(4) The copper base rolled alloy according to any one of the items (1) to (3), wherein the above-described X-ray diffraction intensity ratio is 3.0 or more.

(5) The copper base rolled alloy according to the item (4), wherein the above-described X-ray diffraction intensity ratio is 4.0 or more.

(6) The copper base rolled alloy according to any one of the items (1) to (5), wherein the X-ray diffraction intensity ratio I(111)/I(200) where I(hkl) is the X-ray diffraction intensity from (hkl)plane measured all the way in a sheet thickness direction of the above-described rolled alloy from the above-described rolling direction is 2.0 or more.

(7) The copper base rolled alloy according to any one of the items (1) to (6), which is for the solution treatment and is subjected to a solution treatment.

(8) The copper base rolled alloy according to the item (7), wherein 60% or more of the X-ray diffraction intensity ratio I(111)/I(200) where I(hkl) is the X-ray diffraction intensity from (hkl)plane measured with respect to the above-described rolled surface is maintained after a heat treatment for 5 seconds to 120 minutes at a temperature at which the solution treatment can be conducted.

(9) The copper base rolled alloy according to the item (8), wherein 70% or more of the above-described X-ray diffraction intensity ratio is maintained.

(10) The copper base rolled alloy according to the item (8), wherein 75% or more of the above-described X-ray diffraction intensity ratio is maintained.

(11) The copper base rolled alloy according to any one of the items (1) to (10), which has been subjected to the solution treatment.

(12) The copper base rolled alloy according to the item (11), which is obtained by a solution treatment after at least the rolling for obtaining the X-ray diffraction intensity ratio of the (hkl) plane measured with respect to the above-described rolled surface.

(13) The copper base rolled alloy according to any one of the items (7) to (12), wherein 60% or more of the X-ray diffraction intensity ratio I(111)/I(200) where I(hkl) is the X-ray diffraction intensity from (hkl)plane measured with respect to the above-described rolled surface is maintained after the above-described solution treatment.

(14) The copper base rolled alloy according to any one of the items (1) to (6), containing precipitates of inter-metallic compound containing the above-described element.

(15) The copper base rolled alloy according to the item (14), which is a precipitation hardening alloy.

(16) The copper base rolled alloy according to the item (15), wherein the precipitation hardening treatment is a precipitation hardening treatment at 200° C. or higher.

(17) The copper base rolled alloy according to the item (15), wherein the precipitation hardening treatment is a precipitation hardening treatment at 250° C. or higher.

(18) The copper base rolled alloy according to any one of the items (14) to (17), wherein the average grain size of the above-described alloy is 1 μm or more, and 50 μm or less.

(19) The copper base rolled alloy according to the item (18), wherein the average grain size of the above-described alloy is 20 μm or less.

(20) The copper base rolled alloy according to any one of the items (14) to (19), wherein the ratio, R/t, of minimum bend radius R, at which workability can be ensured, to the sheet material thickness t is 1.0 or less, where 900 bending in a transverse direction to the rolling direction is conducted.

(21) The copper base rolled alloy according to any one of the items (14) to (20), wherein the tensile strength is 500 $N/mm^2$ or more.

(22) The copper base rolled alloy according to any one of the items (14) to (21), wherein the above-described element includes Be.

(23) The copper base rolled alloy according to the item (22), wherein the tensile strength is 650 $N/mm^2$ or more, and 1,000 $N/mm^2$ or less.

(24) The copper base rolled alloy according to any one of the items (14) to (21), wherein the above-described element includes Ti.

(25) The copper base rolled alloy according to the item (24), wherein the tensile strength is 700 $N/mm^2$ or more, and 900 $N/mm^2$ or less.

(26) The copper base rolled alloy according to any one of the items (14) to (21), wherein the above-described elements include Si and Ni.

(27) The copper base rolled alloy according to the item (26), wherein the tensile strength is 500 $N/mm^2$ or more, and 750 $N/mm^2$ or less.

(28) The copper base rolled alloy according to any one of the items (14) to (27), wherein 60% or more of the X-ray diffraction intensity ratio I(111)/I(200) where I(hkl) is the X-ray diffraction intensity from (hkl)plane measured with respect to the above-described rolled surface is maintained after a heat treatment at a temperature of 250° C. or higher, and 550° C. or less for at least 15 minutes.

(29) A manufacturing method for a copper base rolled alloy including:

a rolling step of rolling an alloy cast body having a copper base alloy composition containing 0.05 percent by mass or more, and 10 percent by mass or less of at least one type of element selected from Be, Mg, Al, Si, P, Ti, Cr, Mn, Fe, Co, Ni, Zr, and Sn with shear deformation in such a way that a <111>//ND texture is provided; and a solution treatment step of converting a workpiece, which has been subjected to the rolling step, to a solid solution at 700° C. or higher, and 1,000° C. or lower.

(30) The manufacturing method according to the item (29), wherein the above-described element is at least one type selected from Be, Si, Ti, and Ni.

(31) The manufacturing method according to the item (29) or the item (30), wherein P at a concentration more than or equal to the concentration of incidental impurities is not contained.

(32) The manufacturing method according to any one of the items (29) to (31), wherein the above-described rolling step is a step of conducting rolling in such a way that the <111>//ND texture is provided throughout a sheet thickness direction.

(33) The manufacturing method according to any one of the items (29) to (32), wherein the above-described rolling step includes a step of conducting rolling with the friction coefficient μ of 0.2 or more.

(34) The manufacturing method according to any one of the claims 29 to 33, wherein the above-described rolling step includes a step of conducting rolling under the rolling condition in which the equivalent strain represented by the following Formula (1) becomes 1.6 or more.

$$\bar{\varepsilon} = \frac{2}{\sqrt{3}}\phi \ln\frac{1}{1-r} \tag{1}$$

where $$\phi = \sqrt{1 + \left\{\frac{(1-r)^2}{r(2-r)}\tan\theta\right\}^2} \tag{2}$$

r: rolling reduction rate

θ: an apparent shear angle after rolling of an element, which is perpendicular to a sheet surface before rolling, at a predetermined position in a sheet thickness direction ϕ: shear coefficient

(35) The manufacturing method according to the item (34), wherein the above-described shear coefficient ϕ is 1.2 or more, and 2.5 or less.

(36) The manufacturing method according to any one of claims 29 to 35, wherein the above-described rolling step includes a step of subjecting the above-described alloy cast body to any one rolling selected from differential speed rolling and different roll diameter rolling.

(37) The manufacturing method according to any one of the items (29) to (36), wherein the above-described rolling step includes a step of conducting a differential speed rolling under the condition of rolling speed ratio of 1.2 or more, and 2.0 or less or conducting different roll diameter rolling under the condition satisfying the range of the above-described rotation speed ratio.

(38) The manufacturing method according to any one of the items (29) to (37), including a age hardening treatment step of subjecting a workpiece, which has been subjected to the above-described solution treatment step, to an age hardening treatment.

(39) The manufacturing method according to the item (38), wherein the above-described age hardening treatment step is a step of conducting an aging treatment at 200° C. or higher, and 550° C. or lower.

(40) The manufacturing method according to the item (38), wherein the above-described age hardening treatment temperature is 250° C. or higher, and 500° C. or lower.

(41) A copper base rolled alloy obtained by the manufacturing method for a copper base rolled alloy according to any one of the items (29) to (40).

DETAILED DESCRIPTION OF THE INVENTION

Figure 1:
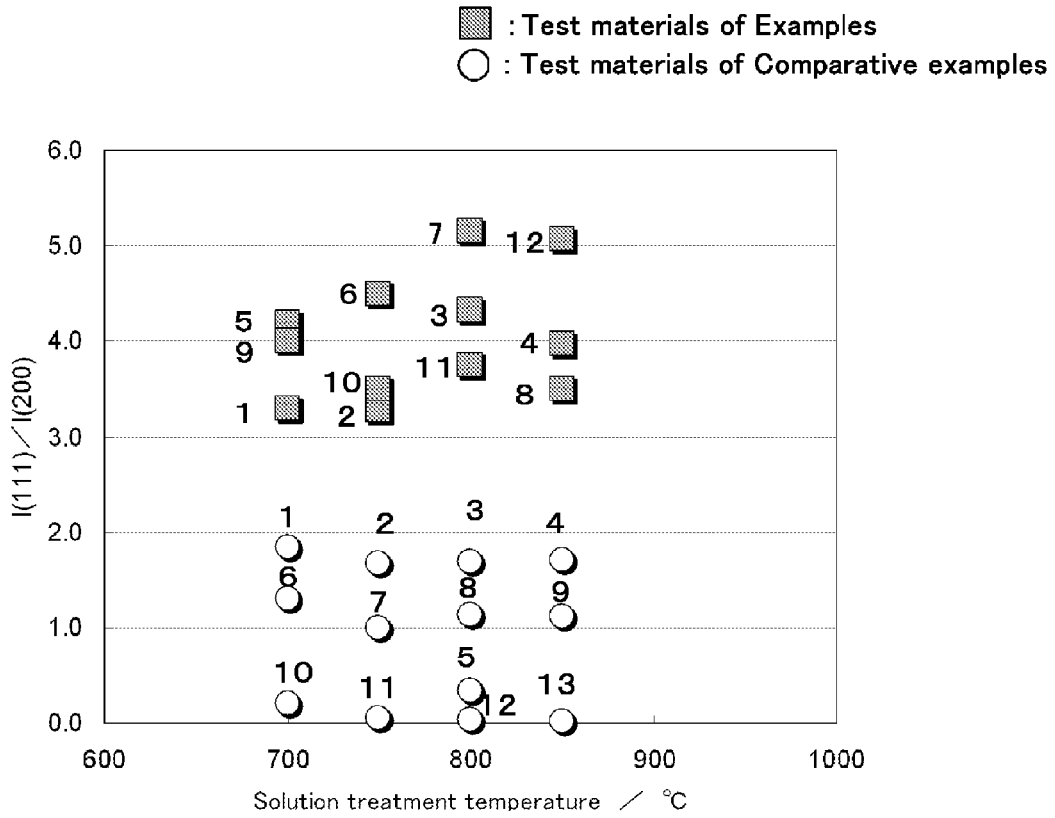
FIG. 1 is a diagram showing the relationship between the solution treatment temperature and the X-ray diffraction intensity ratio I(111)/I(200).

The present invention relates to a copper base rolled alloy having a copper base alloy composition containing 0.05 percent by mass or more, and 10 percent by mass or less of at least one type of element selected from Be, Mg, Al, Si, P, Ti, Cr, Mn, Fe, Co, Ni, Zr, and Sn, wherein the X-ray diffraction intensity ratio I(111)/I(200) where I(hkl) is the X-ray diffraction intensity from (hkl)plane measured with respect to a rolled surface is 2.0 or more. According to the copper base rolled alloy of the present invention, since the X-ray diffraction intensity ratio I(111)/I(200) where I(hkl) is the X-ray diffraction intensity from (hkl)plane measured with respect to the rolled surface thereof is 2.0 or more, a <111>//ND texture is developed. Consequently, a copper base rolled alloy exhibiting excellent workability, e.g., press formability and/or workability in bending, can be provided. Furthermore, in the case where the <111>//ND texture is developed in a precipitation hardening copper base rolled alloy, a copper base rolled alloy exhibiting good workability, strength, and/or an electrical conductivity can be provided.

Moreover, the present invention relates to a manufacturing method for a copper base rolled alloy including a rolling step of rolling an alloy cast body having a copper base alloy composition containing 0.05 percent by mass or more, and 10 percent by mass or less of at least one type of element selected from Be, Mg, Al, Si, P, Ti, Cr, Mn, Fe, Co, Ni, Zr, and Sn with shear deformation in such a way that a <111>/ND texture is provided, and a solid solution treatment step of converting a workpiece, which has been subjected to the above-described rolling step, to a solid solution at 700° C. or higher, and 1,000° C. or lower. According to the manufacturing method of the present invention, since the cast body having the above-described alloy composition is subjected to the above-described rolling step, the <111>//ND texture can be formed even when the solution treatment is conducted thereafter. Since the <111>//ND texture can be maintained even when the solution treatment is conducted, a rolled alloy exhibiting excellent strength and electrical conductivity can be produced through precipitation hardening by the aging treatment conducted thereafter. As a result, a copper base rolled alloy exhibiting excellent press formability and/or workability in bending, strength, and electrical conductivity can be produced.

A copper base rolled alloy and a manufacturing method therefor according to embodiments of the present invention will be described below in detail.

(Copper Base Rolled Alloy)

The copper base rolled alloys of the present invention include rolled alloys after rolling and before the solution treatment, unaged materials after the solution treatment and before the age hardening treatment, and precipitation hardening materials subjected to the age hardening treatment after the solution treatment (including mill hardened materials). Most of all, the precipitation hardening copper base alloys are preferable. Especially, the precipitation hardening copper base alloys, to which high-temperature age hardening treatment at 200° C. or higher is applied is preferable. It is preferable that the age hardening treatment temperature is 250° C. or higher, and more preferably 300° C. or higher. Furthermore, the present copper base rolled alloy may be subjected to various surface treatments, e.g., plating, and the like.

(Copper Base Alloy Composition)

The copper base rolled alloy of the present invention has a copper base alloy composition containing 0.05 percent by mass or more, and 10 percent by mass or less of at least one type of element selected from Be, Mg, Al, Si, P, Ti, Cr, Mn, Fe, Co, Ni, Zr, and Sn. Each of these elements is added as an alloy component to a copper base mother phase so as to make a solid solution or precipitate an inter-metallic compound and, thereby, the element can contribute to an improvement of any one of the mechanical strength, the electrical conductivity, the stress relaxation characteristic, the heat resistance, and the rolling property. Preferably, the content of each of these alloy components is 0.05 percent by mass or more, and 10 percent by mass or less. This is because in the case where the content is in this range, favorable workability, strength, and/or electrical conductivity for the use in small electronic components and mechanical components is provided, if the content is less than 0.05 percent by mass, favorable strength is not obtained, and if the content exceeds 10 percent by mass, favorable electrical conductivity is not obtained.

Preferably, the present copper base rolled alloy contains at least one type of element selected from Be, Si, Ti, and Ni. The element Be can improve the electrical conductivity and the strength of the alloy. In the case where a Cu—Be alloy is obtained, it is preferable that Be is 0.05 percent by mass or more, and 2.0 percent by mass or less in the rolled alloy composition. This is because if the content exceeds 2.0 percent by mass, the strength is reduced on the basis of coarsening of a precipitation formed by Be, and if the content is less than 0.05 percent by mass, sufficient strength cannot be obtained. More preferably, the content is 0.2 percent by mass or more, and 2.0 percent by mass or less. Furthermore, the Cu—Be alloy can contain at least one type selected from Ni, Co, Fe, Al, Mg, Zr, and Pb besides Be.

The element Ti can improve the strength of the alloy effectively on the basis of precipitation of an inter-metallic compound by an aging treatment. In order to obtain a Cu—Ti alloy, it is preferable that the Ti content in the rolled alloy component is specified to be 2.0 percent by mass or more, and 5.0 percent by mass or less. This is because if the content exceeds 5.0 percent by mass, the electrical conductivity and the strength are reduced on the basis of excess precipitation of Cu3Ti, and if the content is less than 2.0 percent by mass, sufficient strength cannot be obtained. More preferably, the content is 2.5 percent by mass or more, and 4.0 percent by mass or less. Furthermore, the Cu—Ti alloy can contain at least one type selected from Fe, Ni, Cr, Si, Al, and Mn besides Ti.

The elements Ni and Si can improve the strength of the alloy effectively on the basis of precipitation of an intermetallic compound by an aging treatment. In order to obtain a Cu—Ni—Si alloy, it is preferable that the Ni content in the rolled alloy component is specified to be 1.0 percent by mass or more, and 4.7 percent by mass or less and, at the same time, it is desirable that the Si content is specified to be 0.3 percent by mass or more, and 1.2 percent by mass or less. If the Ni content exceeds 4.7 percent by mass or the Si content exceeds 1.2 percent by mass, strength is improved, but the electrical conductivity and the workability is significantly reduced. If the Ni content is less than 1.0 percent by mass or the Si content is less than 0.3 percent by mass, sufficient strength is not obtained. More preferably, the Ni content is 2.0 percent by mass or more, and 3.5 percent by mass or less and the Si content is 0.7 percent by mass or more, and 1.0 percent by mass or less. The Cu—Ni—Si alloy can contain at least one type selected from Mg, Fe, Zn, Sn, Cr, Al, Mn, Ti, and Be besides Ni and Si.

Preferably, the alloy composition of the present invention contains Cu and incidental impurities other than the above-described specific elements. Therefore, it is preferable that the rolled alloy composition of the present invention does not contain P (phosphorus) at a concentration more than or equal to the concentration of incidental impurities. This is because if P is contained, P may combine to another element and forms a compound, and in some cases, hardening behavior of the mother phase may be facilitated so that the rolling property may be impaired. In addition, in the case where dispersion into the mother phase is observed, an effect of reducing the friction coefficient may be exerted. Furthermore, as for the raw material for such a copper base mother phase, electrolytic copper or oxygen-free copper can be used.

Moreover, examples of the copper base rolled alloy compositions also include Cu—Cr, Cu—Co, and Cu—Cr—Zr well known to a person skilled in the art.

(Crystal Orientation of Rolled Surface)

As described above, the present rolled alloys include various forms of rolled alloys. The present rolled alloy before the solution treatment has a specific crystal orientation which is maintained at a high rate even after the solution treatment, after the solution treatment, a specific crystal orientation which is maintained even after the subsequent age hardening treatment is provided, and after the age hardening treatment, the strength based on the age hardening treatment and the workability based on the specific crystal orientation can be provided in combination. Therefore, the present alloy is different from an alloy in which the <111>//ND texture is formed by a common finish rolling after the solution treatment in the points that the crystal orientation is maintained at a high rate because of the solution treatment and the high temperature aging. The crystal orientation at each of the stages of after rolling and before the solution treatment, after the solution treatment, and after the age hardening treatment will be described below.

(After Rolling and Before Solution Treatment)

Preferably, the present rolled alloy after rolling and before the solution treatment has the X-ray diffraction intensity ratio I(111)/I(200) of the rolled surface measured with X-ray diffraction is 2.0 or more. In the case where the intensity ratio is 2.0 or more, the intensity I(111) in the orientation indicating excellent press workability and, at the same time, the tendency of excellent workability in bending, indicated by the fact that the intensity I(200) in a cube texture is not exhibited, are obtained sharply. Therefore, good workability can be ensured. This intensity ratio is a ratio of the X-ray diffraction integrated intensity of (111)plane to the X-ray diffraction integrated intensity of (200)plane of the rolled surface. The proportion of the (200)plane of the rolled surface is hard to change because of rolling and the like. Therefore, this diffraction intensity ratio can serve as an index of proportion of the (111)plane of the rolled surface. Furthermore, this diffraction intensity ratio is an index of the <111>//ND texture, and relates to the degree of development of <111>//ND texture in a sheet thickness direction. A rolled alloy in which the <111>//ND texture has developed can be provided with excellent bend formability and press formability.

Each X-ray diffraction intensity ratio of (hkl)plane reflection measured with X-ray diffraction of the rolled alloy is on the basis of the integrated intensity ratio of a surface (up to a depth of about 200 μm). The present inventors have ascertained that the above-described X-ray intensity ratio based on the X-ray diffraction integrated intensity in the vicinity of the rolled surface corresponds to the development tendency of the <111>//ND texture in a sheet thickness direction.

Preferably, the X-ray diffraction intensity ratio of the rolled surface is 2.5 or more. This is because in the case where the intensity ratio is 2.5 or more, with respect to the following solution treatment, X-ray diffraction intensity ratio of 2.0 or more can be maintained easily and, thereby, good workability can be ensured. It is more preferable that the intensity ratio is 3.0 or more. This is because in the case where the intensity ratio is 3.0 or more, the formability and the strength can be obtained while being kept in balance, and they can be maintained even after the solution treatment. Further preferably, the intensity ratio is 4.0 or more.

Preferably, the X-ray diffraction intensity ratio I(111)/I(200) measured with X-ray diffraction from the direction of the rolled surface is 2.0 or more. Here, the X-ray diffraction intensity ratio is a ratio of the X-ray diffraction intensity of the (111)plane parallel to the rolled surface to the X-ray diffraction intensity of the (200)plane parallel to the rolled surface, and relates to the degree of development of <111>//ND texture in any region of a copper base rolled alloy in a sheet thickness direction. In the case where such an X-ray diffraction intensity ratio is 2.0 or more, good workability can be ensured throughout the sheet thickness. A rolled alloy in which the <111>//ND texture has developed all over the region in the sheet thickness direction can be provided with excellent bend formability and press formability throughout the sheet thickness. Regarding the present copper base rolled alloy, it is more preferable that such an intensity ratio is 2.5 or more in consideration of the solution treatment conducted thereafter. In consideration of the merit in formability and application of a heat treatment after rolling for ensuring the strength and the solution treatment, it is preferable that the intensity ratio is 3.0 or more because the intensity I(111) in the orientation indicating excellent press formability and, at the same time, the tendency of excellent workability in bending, which is indicated by the fact that the intensity I(200) in a cube texture is not exhibited, are obtained sharply, and more preferably 4.0 or more.

Furthermore, regarding the present rolled alloy at this stage, it is preferable that 60% or more of the X-ray diffraction intensity ratio I(111)/I(200) measured with respect to the above-described rolled surface is maintained after the solution treatment. According to common rolling, merely about 30% of the intensity ratio is maintained. On the other hand, 60% or more of the above-described X-ray diffraction intensity ratio is maintained and, thereby, good workability based on this crystal orientation can be obtained even after the solution treatment. More preferably, the maintenance factor of the X-ray diffraction intensity ratio of the above-described rolled surface is 70% or more, and further preferably 75% or more.

Incidentally, the solution treatment condition is different depending on the alloy composition. According to the composition of the present rolled alloy, the temperature at which the solution treatment can be conducted is 700° C. or higher and 1,000° C. or lower. In this case, the treatment time can be set at 5 seconds to 2 hours. More preferably, the temperature at which the solution treatment can be conducted is 700° C. or higher and 850° C. or lower. In this case, the treatment time is about 0.5 minutes to 60 minutes. Further preferably, the temperature at which the solution treatment can be conducted is 800° C. In this case, the treatment time can be set at 60 seconds. However, the selection ranges of the temperature and the time may be changed to some extent depending on the copper base alloy composition because the essence of the solution treatment is to heat to a temperature higher than or equal to the solubility curve of compounds, which constitute precipitates in an age hardening treatment, with respect to copper and, thereafter, quench to room temperature so as to keep these constituent elements in the state of a supersaturated solid solution. In a process in which the copper base rolled alloy comes into a solid solution state by heating, when a temperature at which diffusion of atoms occurs sufficiently is reached, recrystallization occurs, that is, a strain-free new grain is formed by rolling. At this time, a lattice arrangement of (111)plane orientation resulting from rolling tends to be replaced by a new lattice arrangement of (200)plane orientation. The occurrence of this recrystallization starts at a temperature lower than the temperature when the solubility curve is reached, and in general, starts in the vicinity of 600° C. regarding a copper base alloy.

(After Solution Treatment)

After the solution treatment, it is preferable that the above-described X-ray diffraction intensity ratio of the rolled surface is 2.0 or more. This is because in the case where the intensity ratio is 2.0 or more, good workability can be ensured. More preferably, the intensity ratio is 3.0 or more. This is because in the case where the intensity ratio is 3.0 or more, the formability and the strength can be obtained while being kept in balance. Further preferably, the intensity ratio is 4.0 or more.

Furthermore, after the solution treatment as well, it is preferable that the X-ray diffraction intensity ratio I(111)/I(200) measured with X-ray diffraction from the direction of the rolled surface is 2.0 or more. In the case where such an X-ray diffraction intensity ratio is 2.0 or more, good workability can be ensured throughout the sheet thickness. A rolled alloy in which the <111>//ND texture has developed all over the region in the sheet thickness direction can be provided with excellent bend formability and press formability throughout the sheet thickness. In consideration of the formability and the strength, it is preferable that the intensity ratio is 3.0 or more, and more preferably 4.0 or more.

In particular, regarding a Cu—Be rolled alloy, it is more preferable that the above-described X-ray diffraction intensity ratio is 3.0 or more, and further preferably 4.0 or more. Furthermore, regarding a Cu—Ti rolled alloy, it is more preferable that the X-ray diffraction intensity ratio is 4.5 or more. Moreover, regarding a Cu—Ni—Si alloy, it is more preferable that the above-described X-ray diffraction intensity ratio is 3.5 or more, and further preferably 4.0 or more.

(After Age Hardening Treatment)

After the age hardening treatment, according to the present rolled alloy composition, 250° C. or higher, and 500° C. or lower is preferable. Typically, the temperature can be 300° C. or higher, and 450° C. or lower. After such an age hardening treatment, the X-ray diffraction intensity ratio of the rolled surface and the X-ray diffraction intensity ratio from the rolled surface direction before the age hardening treatment are maintained on an "as is" basis. This is because these age hardening treatment temperatures are lower than the recrystallization temperature of the above-described copper base rolled copper alloy, and are maintained on an "as is" basis within a time unit controllable in an industrial scale. Therefore, the precipitation hardening rolled alloy of the present invention can be provided with the strength based on the age hardening treatment and good workability based on the specific crystal orientation in combination. For example, regarding the Cu—Be alloy, it is favorable that the temperature of the age hardening treatment is 300° C. for 30 minutes.

(Method for Measuring Crystal Orientation)

The diffraction intensity of the (111)plane and the diffraction intensity of the (200)plane through X-ray diffraction are evaluated by allowing an X-ray to enter an X-ray diffraction apparatus at an incident angle (θ) in such a way that a 2θ scanning surface becomes perpendicular to a sample and includes a rolling direction (RD), determining each of the integrated intensity of the {111}plane and the integrated intensity of a peak of diffraction ray from the (200)plane detected by 2θ scanning, and calculating the ratio thereof. In a common X-ray diffraction measuring method, a relationship in which the incident angle and the reflection angle of X-ray with respect to the sample surface become equal is kept. Therefore, in an actual apparatus, a vessel serving as an X-ray generation source is fixed, and the sample and a counter tube are rotated in such a way that the counter tube forms an angle of 2θ with the incident ray when a sample surface is at an angle of θ with respect to the incident ray. At this time, in a common method, an object surface of the measurement becomes a surface constantly parallel to the sample surface. Since the vessel is Cu, the tube voltage is 40 kV, the tube current is 200 mA, and the X-ray penetration depth is about 200 μm, in the case where the inside of the sheet thickness is measured, it is enough that one surface is etched until a desired sheet thickness is reached.

(Average Grain Size)

Preferably, the average grain size of the present rolled alloy is 1 μm or more, and 50 μm or less. This is because if the average size is less than 1 μm, recrystallization proceeds, but the solid solubility remains unsatisfactory, and if the average size exceeds 50 μm, the solid solubility is satisfactory, but grains become too coarse so as to impair the press workability and the formability. More preferably, the average size is 20 μm or less. This is because in the case where the average grain size is 20 μm or less, the strength and the formability of the present rolled alloy are improved. Preferably, the average size is 15 μm or less, and more preferably 10 μm or less. The average grain size of the present rolled alloy can be measured on the basis of JIS H0501 Quadrature method. A circle or a rectangle having a known area (usually 5,000 $mm^2$, for example, in the case where a circle is concerned, the diameter is 79.8 mm) is drawn on a photograph or a focusing screen, and the sum of the number of grains completely included in the area and one-half the number of grains cut by the circumference of the circle or the rectangle is assumed to be the total number of grains. The grain size is represented by the following formulae, where a grain is assumed to be a square.

$$d=1/M\sqrt{(A/n)}$$

$$n=Z+w/2$$

where d: grain size (mm)

M: magnification used

A: measurement area ($mm^2$)

Z: the number of grains completely included in the measurement area A w: the number of grains in the circumferential portion n: the total number of grains (Mechanical Strength and the Like)

Regarding the present precipitation hardening rolled alloy, preferably, the ratio, R/t, of minimum bend radius R, at which workability can be ensured, to the sheet material thickness t is 1.0 or less, where 90° bending in a transverse direction to the rolling direction is conducted. This is because the R/t of 1.0 or less is suitable for forming and working of a small electronic component, and the R/t exceeding 1.0 is limited to forming and working of a large or middle electronic component. More preferably, the R/t is 0.5 or less.

Regarding the present precipitation hardening rolled alloy, preferably, the tensile strength is 500 $N/mm^2$ or more. This is because in the case where the tensile strength is 500 $N/mm^2$ or more, even when a small electronic component is produced, a sufficient contact pressure can be obtained. Conversely, if the tensile strength is less than 500 $N/mm^2$, a shortage in the contact pressure of the component occurs.

The tensile strength can be measured by JIS Z 2241 Method of tensile test for metallic materials, and besides measurement can be conducted by a method having accuracy and precision equivalent to this method. Furthermore, the R/t can be measured by JIS Z 2248 Method of bend test for metallic materials. The minimum bend radius refers to an inside diameter of a bent portion. The sheet thickness may be specified to be, for example, 0.6 mm, and the width may be specified to be, for example, 10 mm.

Regarding the Cu—Be rolled alloy, preferably, the tensile strength is 650 $N/mm^2$ or more, and 1,000 $N/mm^2$ or less. Furthermore, preferably, the R/t is 1.0 or less. The Cu—Be rolled alloy having such strength and bend formability can be worked with a higher degree of flexibility. More preferably, the tensile strength is 800 $N/mm^2$ or more, and further preferably 900 $N/mm^2$ or more. Furthermore, more preferably, the R/t is 0.5 or less.

Regarding the Cu—Ti rolled alloy, preferably, the above-described diffraction intensity ratio is 3.0 or more, more preferably 4.0 or more, and further preferably 5.0 or more. Preferably, the tensile strength is 700 $N/mm^2$ or more, and 900 $N/mm^2$ or less. Furthermore, preferably, the R/t is 1.0 or less. The Cu—Ti rolled alloy having such strength and bend formability can be worked with a higher degree of flexibility. More preferably, the tensile strength is 800 $N/mm^2$ or more, and further preferably 750 N/m2 or more. Furthermore, more preferably, the R/t is 0.5 or less.

Regarding the Cu—Ni—Si rolled alloy, preferably, the above-described diffraction intensity ratio is 3.0 or more, more preferably 4.0 or more, and further preferably 5.0 or more. Preferably, the tensile strength is 500 $N/mm^2$ or more, and 750 $N/mm^2$ or less. Furthermore, preferably, the R/t is 1.0 or less. The Cu—Ni—Si rolled alloy having such strength and bend formability can be worked with a higher degree of flexibility. More preferably, the tensile strength is 600 $N/mm^2$ or more, and further preferably 750 N/m2 or more. Furthermore, more preferably, the R/t is 0.5 or less.

(Manufacturing Method for Copper Base Rolled Alloy)

A manufacturing method suitable for producing the present copper base rolled alloy will be described below.

(Melting and Casting)

Regarding the copper base rolled alloy, raw materials are blended on the basis of a predetermined copper base alloy composition, and are melted and cast. That is, alloy raw materials are introduced into an appropriate furnace, and are melted. Thereafter, the materials are poured into a casting mold, and are solidified so that a billet or the like is cast. The resulting cast body, e.g., the billet, may be appropriately deformed into a desired dimension through application of a load, or the billet or the like hardened by working may be subjected to a heat treatment thereafter so as to be softened again.

(Rolling)

In the rolling, usually, a hot rolling step and a cold rolling step are conducted. The hot rolling step is not specifically limited and a condition in accordance with the alloy composition or the shape and the like of a desired alloy material may be adopted. On the other hand, regarding the cold rolling step, it is preferable that rolling is conducted with shear deformation. A <111>//ND texture which can be maintained after a solution treatment can be formed by conducting the rolling with shear deformation.

The rolling step with shear deformation can be cold rolling conducted under a condition of, for example, the friction coefficient μ of 0.2 or more (hereafter may be referred to as a non-lubricating condition). In the case where the cold rolling step under such a non-lubricating condition is conducted, a shear stress can be applied to a workpiece. The cold rolling step under such a non-lubricating condition can be conducted by avoiding use of a lubricant which is used in general cold rolling.

A shear stress is applied to a workpiece by the cold rolling step under the non-lubricating condition, development of the <111>//ND texture is facilitated and, as a result, the <111>//ND texture can be maintained in a subsequent solution treatment. Therefore, the workpiece, which has been converted to the solid solution, can exhibit excellent workability due to such a texture. In the past, it has been unknown that this type of texture is maintained effectively after cold rolling with application of the shear stress and the solution treatment.

Regarding the rolling step with shear deformation, it is preferable that rolling is conducted under a rolling condition in which an equivalent strain ϵ represented by the following Formula (1) becomes 1.6 or more. A required rolling condition can be obtained easily by using the following Formula (1).

$$\bar{\varepsilon} = \frac{2}{\sqrt{3}}\phi \ln\frac{1}{1-r} \tag{1}$$

where $$\phi = \sqrt{1 + \left\{\frac{(1-r)^2}{r(2-r)}\tan\theta\right\}^2} \tag{2}$$

r: rolling reduction rate

θ: apparent shear angle after rolling of an element, which is perpendicular to a sheet surface before rolling, at a predetermined position in a sheet thickness direction ϕ: shear coefficient The above-described Formula (2) was derived by the present inventors from the rolling reduction rate r obtained when the workpiece was subjected to non-lubricating rolling and the like and the apparent shear angle θ of the workpiece. The equivalent strain ϵ in the above-described Formula (1) is derived from the rolling reduction rate r and the apparent shear angle θ by using the above-described Formula (2). Therefore, the non-lubricating rolling step can be conducted while a non-lubricating rolling condition (a rotation speed ratio or a different roll diameter ratio, a rolling reduction rate, the number of passes, and the like) is selected in advance in such a way that a rolling reduction rate r and an apparent shear angle θ for obtaining a desired equivalent strain ϵ, that is, obtaining a desired shear coefficient ϕ, are obtained.

The relationship between the rolling reduction rate r and the apparent shear angle θ can be determined as described below. That is, a hole having a diameter of 3 mm is made perpendicularly to the sheet surface in a center portion in a sheet width direction before rolling, a pure copper round bar having an equal diameter of 3 mm is filled therein. After rolling, the sheet is cut along a rolling direction in the vicinity of the center of the sheet width, the deformation of the round bar which appears on the cross-section is observed and, thereby, the relationship between the rolling reduction rate and the shear angle can be determined.

If the equivalent strain ϵ in the above-described Formula (1) is less than 1.6, the shear force does not reach the inside of the sheet thickness direction, and development of the <111>// ND texture in the sheet thickness direction becomes difficult to facilitate. Furthermore, although it is unnecessary to specify an upper limit, it is physically impossible to obtain a condition to exceed 4.0 and, therefore, the equivalent strain ϵ is substantially 4.0 or less.

According to the experiments conducted by the present inventors, in order to satisfy the non-lubricating rolling condition in which the equivalent strain E in the above-described Formula (1) is 1.6, it is preferable that the shear coefficient ϕ becomes 1.2 or more, and 2.5 or less in the case where differential speed rolling or different roll diameter rolling is adopted. This is because a sufficiently large shear angle θ can be employed in this range. It is realized by specifying an appropriate value of each of a differential speed ratio or a different roll diameter ratio, a rolling reduction rate, and the number of passes in the rolling step under the non-lubricating rolling condition. For example, in differential speed rolling, a preferable shear coefficient ϕ is obtained easily by specifying the differential speed ratio to be 1.2 or more. This is because the shear angle increases in the case where the differential speed ratio is 1.2 or more, and more preferably 1.6 or more. Furthermore, 2.0 or less is preferable. In different roll diameter rolling, it is more preferable that the shear coefficient ϕ is specified to be 1.4 or more, and 2.2 or less. In order to realize a preferable shear coefficient ϕ in the different roll diameter rolling, it is preferable that the different diameter ratio is set in such a way that the differential speed ratio becomes 1.2 or more, and 2.0 or less for ensuring the shear angle θ.

The rolling step with such shear deformation can be conducted by adopting any one of rolling methods of equal speed rolling, differential speed rolling, and different roll diameter rolling. In particular, in the case where the above-described texture is formed from each surface in the sheet thickness direction toward the sheet center direction, at least the equal speed rolling can be employed to apply the shear stress effectively to a region 25% or less of the thickness of the workpiece, and it is preferable that the differential speed rolling or the different roll diameter rolling is employed to apply the shear stress effectively to a whole region from the surface to the sheet center portion of the workpiece. In order to introduce such a shear stress throughout the sheet thickness, it is enough that the differential speed rolling or the different roll diameter rolling is conducted in such a way as to make the differential speed ratio 1.2 or more, as described above.

The above-described cold rolling step can be conducted in various forms, for example, the equal speed rolling in which upper and lower rolls are rotated at an equal speed, the differential speed rolling conducted with different rotation speeds, and the different roll diameter rolling conducted with different roll diameters. Preferably, the differential speed rolling or the different roll diameter rolling is employed from the viewpoint of effective application of the shear stress to the workpiece. For example, in the differential speed rolling, it is preferable that the differential speed ratio is specified to be 1.2 or more. This is because in the case where the differential speed ratio is 1.2 or more, the shear strain can be introduced throughout the sheet thickness easily. More preferably, the differential speed ratio is 1.4 or more. Furthermore, 2.0 or less is preferable. Moreover, in the different roll diameter rolling as well, it is enough that the different diameter ratio corresponding to the above-described differential speed ratio (1.2 or more is preferable, 1.4 or more is more preferable, and an upper limit is 2.0 or less) is realized.

The number of passes of the cold rolling step under the non-lubricating condition and the timing of conduction in the whole process of the cold rolling may not be limited but be specified within a range in which a predetermined diffraction intensity ratio can be obtained. Two passes or more is preferable, and four passes or more is more preferable. Furthermore, in the case where the differential speed rolling or the different roll diameter rolling is conducted, the contact surface of the workpiece to a high speed roll or a large diameter roll may be changed appropriately on a pass basis or on predetermined passes basis. These rolls may contact merely one surface. Moreover, the rolling reduction rate in the cold rolling under the non-lubricating condition is not specifically limited, but can be specified to be 30% or more, and 98% or less. Preferably, rolling reduction rate is specified to be 50% or more, and 95% or less.

For example, it is possible to conduct within the range of room temperature to about 300° C. Preferably, 200° C. or lower is employed.

(Solution Treatment)

Subsequently, the solution treatment of the workpiece is conducted. A solid solution is a treatment to allow additional components in a copper base alloy composition to form a solid solution with copper and, specifically, a treatment to heat and then quench the workpiece. Preferably, the heating temperature for a solid solution treatment is 700° C. or higher, and 1,000° C. or lower although the temperature is different depending on the alloy composition and the like. More preferably, the temperature is 700° C. or higher, and 850° C. or lower. Furthermore, the time of keeping at that temperature can be set appropriately and, for example, it is possible to set the time within the range of 5 seconds or more, and 900 seconds or less.

In the copper base rolled alloy obtained by the above-described steps, the <111>//ND texture has been developed by the non-lubricating rolling step in the above-described rolling step, and this rolling texture is maintained even after the solution treatment. As a result, after the solution treatment, the X-ray diffraction intensity ratio I(111)/I(200) where I(hkl) is the X-ray diffraction intensity from (hkl)plane of the rolled surface measured with X-ray diffraction is 2.0 or more. Preferably, this diffraction intensity ratio is 3.0 or more, and more preferably 4.0 or more.

Furthermore, regarding the resulting copper base rolled alloy, the X-ray diffraction intensity ratio from a rolled surface direction is also 2.0 or more. Preferably, this diffraction intensity ratio is 3.0 or more, and more preferably 4.0 or more.

As described above, such X-ray diffraction intensity ratios are maintained in the present copper base rolled alloy which is subjected to a predetermined heat treatment and which is provided as a mill hardened material besides the present copper base rolled alloy which is subjected to finish rolling and the like appropriately and which is provided as an unaged material before the age hardening treatment. Moreover, the X-ray diffraction intensity ratios are also maintained after the age hardening treatment.

Therefore, according to the present manufacturing method, regarding each of the unaged material obtained through the solution treatment, furthermore the mill hardened material, and the age-hardening-treated material (workpiece), a copper base rolled alloy having the <111>//ND texture maintained and exhibiting excellent workability in bending and press workability can be obtained. Since such a texture can be maintained after the solution treatment, a copper base rolled alloy exhibiting excellent workability as well as the strength and the electrical conductivity and products of the alloy can be provided.

(Finish Rolling and Hardening Treatment)

After a solid solution treatment, finish rolling can be conducted, if necessary. The finish rolling can be conducted under a lubricating condition (friction coefficient μ is less than 0.2, preferably 0.15 or less) in the vicinity of room temperature. The reduction rate can be set appropriately, and be 20% or less, for example. Furthermore, after the finish rolling, bending and the like can be conducted appropriately. The hardening treatment includes a hardening treatment for obtaining a mill hardened material and an age hardening treatment. For example, the age hardening treatment can be conducted at 200° C. or higher, and 550° C. or lower for 1 minute or more, and 200 minutes or less in accordance with the copper base alloy composition. Moreover, the heat treatment for the mill hardened material can be conducted under a condition in which hardening is suppressed as compared with that in the age hardening treatment condition.

Preferably, the age hardening treatment is conducted at a temperature lower than the temperature at which the solution treatment can be conducted from the viewpoint of preventing compounds, which is to be precipitated, from forming a solid solution again. However, in consideration of an economical age hardening treatment, 250° C. or higher is preferable. For example, regarding the Cu—Be alloy, it is preferable that the age hardening treatment is conducted at 250° C. or higher, and 500° C. or lower. This is because there is economy in this temperature range in an industrial scale. Furthermore, regarding the Cu—Ti alloy, it is preferable that the age hardening treatment is conducted at 400° C. or higher, and 550° C. or lower from the same viewpoint as described above. Moreover, regarding the Cu—Ni—Si alloy, it is preferable that the age hardening treatment is conducted at 400° C. or higher, and 550° C. or lower from the same viewpoint.

The present rolled alloy through the above-described age hardening treatment can maintain the X-ray diffraction intensity ratio of the rolled surface and the X-ray diffraction intensity ratio from the rolled surface direction, which are held after the solution treatment, even after the age hardening treatment. Consequently, the alloy is provided with the workability based on the above-described X-ray diffraction intensity ratio and the mechanical strength and the like based on the solution treatment and the age hardening treatment.

EXAMPLES

The present invention will be specifically described below with reference to the examples. However the present invention is not limited to the following examples.

Example 1

Evaluation of Crystal Orientation and the Like of Rolled Surface after Solution Treatment (Preparation of Test Material)

Electric copper (Cu) or oxygen-free copper (Cu) was used as a primary raw material, and three types of alloy raw materials were blended on the basis of the composition shown in Table 1, and melting was conducted in a high frequency melting furnace in a vacuum or in an Ar atmosphere, so that an ingot having a diameter of 80 mm was cast. A sheet material having a thickness of 10 mm and a width of 50 mm was cut from the ingot. Subsequently, regarding each of the resulting sheet materials, a rolling step was conducted under the condition shown in Table 2 and, in addition, a solid solution treatment step was conducted while the temperature was changed. Furthermore, a finish rolling step and an age hardening treatment were conducted, so that a sheet having a thickness of 0.6 mm was produced and, thereby, test materials 1 to 12 of Examples of the present invention were prepared. Regarding Comparative examples, rolled materials were produced as in Example except that in the rolling step, non-lubricating cold rolling step was not conducted but merely a common lubricating cold rolling step was conducted, and were taken as test materials 1 to 13 of Comparative example.

TABLE 1

| Alloy | Composition (wt. %) | | | | | | |
|---|---|---|---|---|---|---|---|
| species | Cu | Be | Co | Ti | Ni | Si | Mg |
| CuBe | rest | 1.83 | 0.24 | — | — | — | — |
| CuTi | rest | — | — | 3.3 | — | — | — |
| CuNiSi | rest | — | — | — | 3.12 | 0.76 | 0.15 |

TABLE 2

| [Production step] | Production condition | Production condition |
|---|---|---|
| Casting | Comparative example | Example |
| ↓ | ↓ | ↓ |
| Rolling | Lubricating (friction coefficient μ = 0.12)<br>Equal speed rolling<br>Working temperature range: room temperature | Non-lubricating (friction coefficient μ = 0.3)<br>Differential speed rolling (rotation speed ration 1.4)<br>Working temperature range: room temperature |
| ↓ | ↓ | ↓ |

TABLE 2-continued

| | | |
|---|---|---|
| Solution treatment | 700~850° C.<br>60 sec | 700~850° C.<br>60 sec |
| (Finish rolling) | Lubricating (friction coefficient μ = 0.12)<br>Room temperature<br>Reduction rate: 9% | Lubricating (friction coefficient μ = 0.12)<br>Room temperature<br>Reduction rate: 9% |
| Aging treatment | CuBe: 300° C. × 40 min<br>CuTi: 420° C. × 120 min<br>CuNiSi: 450° × 120 min | CuBe: 300° C. × 40 min<br>CuTi: 420° C. × 120 min<br>CuNiSi: 450° × 120 min |

The crystal orientation of the resulting test material was evaluated by using an X-ray diffraction apparatus. The evaluation was conducted by using the above-described method. The average grain size of the test material was measured on the basis of JIS H 0501 Quadrature method. The results are shown in Table 3, FIG. 1, and FIG. 2.

TABLE 3

| Test mateiral | | Alloy species | Solid solution temperature ° C. | Intensity ratio | Average grain size μm |
|---|---|---|---|---|---|
| Example | 1 | CuBe | 700 | 3.3 | 4.5 |
| | 2 | CuBe | 750 | 3.3 | 7 |
| | 3 | CuBe | 800 | 4.3 | 13 |
| | 4 | CuBe | 850 | 4.0 | 32 |
| | 5 | CuTi | 700 | 4.2 | 2.3 |
| | 6 | CuTi | 750 | 4.5 | 7 |
| | 7 | CuTi | 800 | 5.2 | 17 |
| | 8 | CuTi | 850 | 3.5 | 33 |
| | 9 | CuNiSi | 700 | 4.0 | 2 |
| | 10 | CuNiSi | 750 | 3.5 | 2.6 |
| | 11 | CuNiSi | 800 | 3.8 | 5.5 |
| | 12 | CuNiSi | 850 | 5.1 | 19 |
| Comparative Example | 1 | CuBe | 700 | 1.8 | 5 |
| | 2 | CuBe | 750 | 1.7 | 8 |
| | 3 | CuBe | 800 | 1.7 | 16 |
| | 4 | CuBe | 850 | 1.7 | 35 |
| | 5 | CuBe | 800 | 0.3 | 17 |
| | 6 | CuTi | 700 | 1.3 | 2 |
| | 7 | CuTi | 750 | 1.0 | 8 |
| | 8 | CuTi | 800 | 1.1 | 19 |
| | 9 | CuTi | 850 | 1.1 | 35 |
| | 10 | CuNiSi | 700 | 0.2 | 1.5 |
| | 11 | CuNiSi | 750 | 0.1 | 3 |
| | 12 | CuNiSi | 800 | 0.0 | 6 |
| | 13 | CuNiSi | 850 | 0.0 | 21 |

Figure 2:
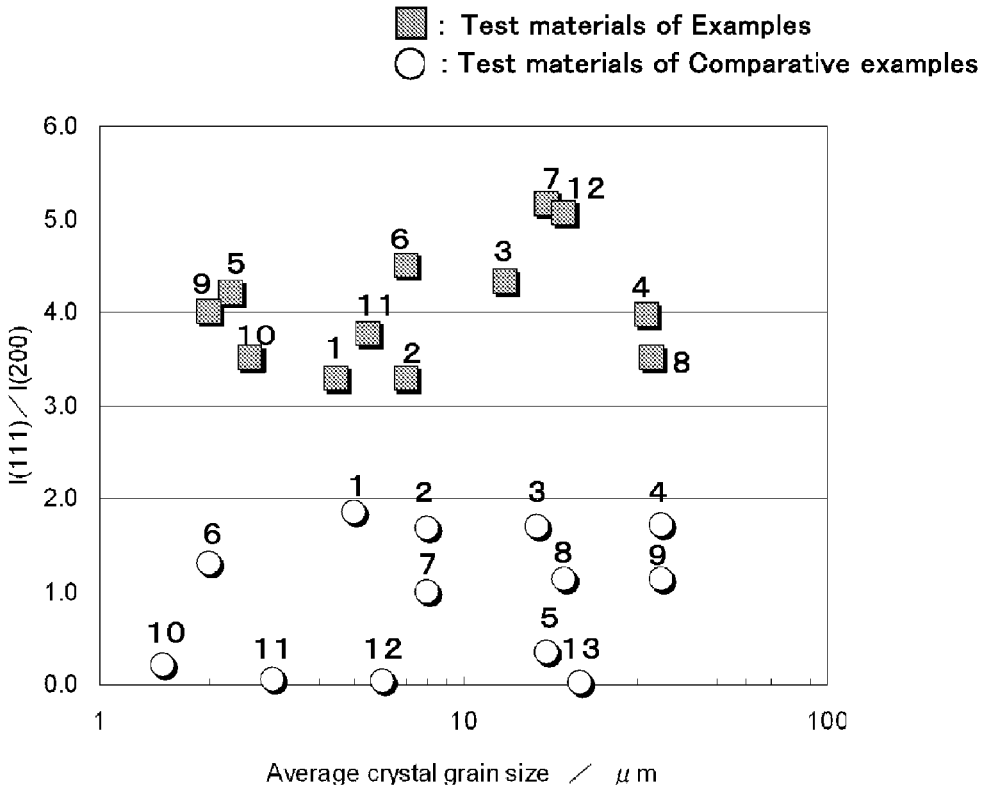
FIG. 2 is a diagram showing the relationship between the average grain size and the X-ray diffraction intensity ratio I(111)/I(200).

As shown in Table 3, FIG. 1, and FIG. 2, among the resulting test materials, each of test materials 1 to 12 of Examples, in which the non-lubricating rolling step was conducted, exhibited an X-ray diffraction intensity ratio I(111)/I(200) of 3.0 or more. On the other hand, each of test materials 1 to 13 of Comparative examples exhibited an X-ray diffraction intensity ratio of merely less than 2.0. In particular, the Cu—Be alloy exhibited less than 2.0, the Cu—Ti alloy exhibited less than 1.5, and the Cu—Ni—Si alloy exhibited less than 0.5. Furthermore, as shown in FIG. 2, the average grain sizes of the test materials of Examples and Comparative examples are not different significantly. Therefore, it was believed that the non-lubricating rolling step hardly had an influence on the grain size. Consequently, it was made clear that in the case where the non-lubricating rolling step was conducted, the <111>//ND texture was selectively developed and, in addition, the texture was able to be maintained even after the solution treatment. Regarding the test material of Example, X-ray diffraction was conducted in the state in which one surface was etched until a desired sheet thickness (depth) was reached and, thereby, the above-described X-ray diffraction intensity ratio was measured. As a result, it was made clear that the integrated intensity ratio at the center of the sheet thickness was 2.8 to 4.4 and the <111>//ND texture was developed in the sheet thickness direction.

Example 2

Evaluation of Characteristics

Among the test materials obtained in Example 1, regarding the test materials 3, 7, and 12 of Example, the age hardening treatment condition was variously changed as shown in Table 4 and, thereby, test materials 3a to 3j, test materials 7a to 7h, and test materials 12a to 12g were prepared. Likewise, regarding the test materials 3, 8, and 13 of Comparative example, the age hardening treatment condition was variously changed and, thereby, test materials 3a to 3i, test materials 8a to 8h, and test materials 13a to 13g were prepared. Regarding these various test materials, the tensile strength and the bend factor R/t were measured. The tensile strength was measured on the basis of JIS Z 2241 Method of tensile test for metallic materials. The bend factor R/t was measured on the basis of JIS Z 2248 Method of bend test for metallic materials (sheet thickness 0.6 mm, width 10 mm). The results with respect to the test materials of Examples and Comparative examples are shown in Table 5, Table 6, and FIG. 3.

TABLE 4

| Type of alloy | Temperature (° C.) | Time (min) |
|---|---|---|
| CuBe | 300 | 20~120 |
| CuTi | 420 | 20~250 |
| CuNiSi | 450 | 20~250 |

TABLE 5

| Test material | Alloy species | Tensile strength N/mm2 | R/t | Solid solution temperature ° C. |
|---|---|---|---|---|
| 3a | Cu—Be | 680 | 0.0 | 800 |
| 3b | Cu—Be | 766 | 0.0 | 800 |
| 3c | Cu—Be | 799 | 0.0 | 800 |
| 3d | Cu—Be | 850 | 0.2 | 800 |
| 3e | Cu—Be | 880 | 0.5 | 800 |
| 3f | Cu—Be | 920 | 0.4 | 800 |
| 3g | Cu—Be | 1045 | 1.2 | 800 |
| 3h | Cu—Be | 1020 | 1.2 | 800 |
| 3i | Cu—Be | 970 | 0.8 | 800 |
| 3j | Cu—Be | 1120 | 1.5 | 800 |
| 7a | Cu—Ti | 733 | 0.0 | 800 |
| 7b | Cu—Ti | 799 | 0.5 | 800 |
| 7c | Cu—Ti | 850 | 0.8 | 800 |
| 7d | Cu—Ti | 896 | 1.2 | 800 |
| 7e | Cu—Ti | 941 | 1.0 | 800 |
| 7f | Cu—Ti | 991 | 1.6 | 800 |
| 7g | Cu—Ti | 1011 | 1.7 | 800 |
| 7h | Cu—Ti | 1058 | 2.5 | 800 |
| 12a | Cu—Ni—Si | 619 | 0.0 | 850 |
| 12b | Cu—Ni—Si | 534 | 0.0 | 850 |
| 12c | Cu—Ni—Si | 620 | 0.5 | 850 |
| 12d | Cu—Ni—Si | 674 | 0.6 | 850 |
| 12e | Cu—Ni—Si | 751 | 1.3 | 850 |
| 12f | Cu—Ni—Si | 815 | 1.7 | 850 |
| 12g | Cu—Ni—Si | 915 | 2.4 | 850 |

TABLE 6

| Test material | Alloy species | Tensile strength N/mm2 | R/t | Solid solution temperature ° C. |
|---|---|---|---|---|
| 3a | Cu—Be | 660 | 0.0 | 800 |
| 3b | Cu—Be | 720 | 0.0 | 800 |
| 3c | Cu—Be | 1033 | 1.7 | 800 |
| 3d | Cu—Be | 880 | 1.0 | 800 |
| 3e | Cu—Be | 790 | 0.5 | 800 |
| 3f | Cu—Be | 830 | 0.8 | 800 |
| 3g | Cu—Be | 930 | 1.0 | 800 |
| 3h | Cu—Be | 963 | 1.5 | 800 |
| 3i | Cu—Be | 1120 | 2.5 | 800 |
| 8a | Cu—Ti | 733 | 0.0 | 800 |
| 8b | Cu—Ti | 799 | 0.9 | 800 |
| 8c | Cu—Ti | 850 | 1.5 | 800 |
| 8d | Cu—Ti | 935 | 1.6 | 800 |
| 8e | Cu—Ti | 941 | 1.5 | 800 |
| 8f | Cu—Ti | 958 | 2.2 | 800 |
| 8g | Cu—Ti | 1011 | 2.5 | 800 |

TABLE 6-continued

| Test material | Alloy species | Tensile strength N/mm2 | R/t | Solid solution temperature ° C. |
|---|---|---|---|---|
| 8h | Cu—Ti | 1038 | 3.2 | 800 |
| 13a | Cu—Ni—Si | 591 | 0.0 | 850 |
| 13b | Cu—Ni—Si | 554 | 0.0 | 850 |
| 13c | Cu—Ni—Si | 613 | 0.9 | 850 |
| 13d | Cu—Ni—Si | 670 | 1.2 | 850 |
| 13e | Cu—Ni—Si | 719 | 2.0 | 850 |
| 13f | Cu—Ni—Si | 834 | 2.4 | 850 |
| 13g | Cu—Ni—Si | 912 | 3.4 | 850 |

Figure 3:
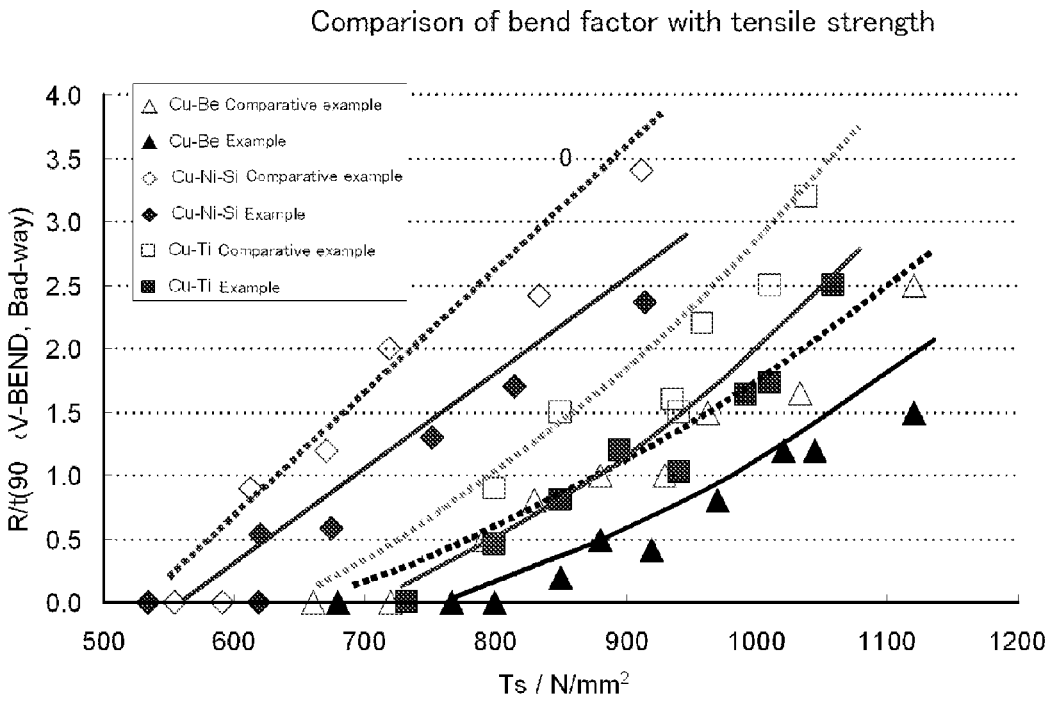
FIG. 3 is a diagram showing the relationship between the tensile strength and the bend factor.

As is clearly shown in Table 5, Table 6, and FIG. 3, the test materials of Examples had the tensile strength and the bend formability as compared with the test materials of Comparative examples. Consequently, it was made clear that regarding the copper base rolled alloy, the bend formability and the strength were able to be improved by developing the <111>// ND texture.

Example 3

X-Ray Diffraction Intensity Ratio Before and after Solution Treatment (Preparation of Test Material)

Test materials were prepared as in Example 1 on the basis of the composition shown in Table 1 as in Example 1. Regarding the test materials, the cold rolling step was conducted as in Example 1 except that the rotation speed ratio, the rolling reduction rate, and the number of passes were changed in such a way as to obtain the shear coefficient $\phi$ and equivalent strain E shown in Table 7. Thereafter, the solution treatment was conducted for 60 seconds at solid solution temperature shown in Table 7, so that 12 samples in total of test materials 10 to 120 of Example were prepared. Furthermore, 13 samples in total of test materials 1010 to 1130 of comparative example were prepared as in the test materials 10 to 120 of Example except that the cold rolling step was conducted under a lubricating condition and, thereafter, the solution treatment was conducted for 60 seconds at solid solution temperature shown in Table 7.

The crystal orientation of the resulting test materials were evaluated by using an X-ray diffraction apparatus. The evaluation of the X-ray diffraction intensity ratio and the average grain size was conducted by using the same method as that in Example 1. The results are collectively shown in Table 7.

TABLE 7

| | No. | Alloy species | Solid solution temperature (° C.) | Friction coefficient μ | Shear coefficient $\phi$ | Equivalent strain $\epsilon$ | Intensity ratio: I(111)/I(200) (after rolling) | Intensity ratio: I(111)/I(200) (after conversion to solid solution) | Intensity ratio maintenance factor (after conversion to solid solution/after rolling) | Average grain size (μm) |
|---|---|---|---|---|---|---|---|---|---|---|
| Example | 10 | CuBe | 700 | 0.3 | 1.47 | 1.6 | 4.3 | 3.3 | 0.77 | 4.5 |
| Example | 20 | CuBe | 750 | 0.3 | 1.26 | 2.0 | 4.2 | 3.3 | 0.79 | 7 |
| Example | 30 | CuBe | 800 | 0.3 | 1.21 | 2.7 | 5.3 | 4.3 | 0.81 | 13 |
| Example | 40 | CuBe | 850 | 0.3 | 1.38 | 2.2 | 5.0 | 4.0 | 0.80 | 32 |
| Example | 50 | CuTi | 700 | 0.3 | 1.47 | 1.6 | 5.2 | 4.2 | 0.81 | 2.3 |
| Example | 60 | CuTi | 750 | 0.3 | 1.38 | 2.2 | 5.4 | 4.5 | 0.83 | 7 |
| Example | 70 | CuTi | 800 | 0.3 | 2.46 | 3.4 | 6.0 | 5.2 | 0.87 | 17 |
| Example | 80 | CuTi | 850 | 0.3 | 1.38 | 1.6 | 4.4 | 3.5 | 0.80 | 33 |
| Example | 90 | CuNiSi | 700 | 0.3 | 1.60 | 2.3 | 5.0 | 4.0 | 0.80 | 2 |
| Example | 100 | CuNiSi | 750 | 0.3 | 1.26 | 2.0 | 4.5 | 3.5 | 0.78 | 2.6 |
| Example | 110 | CuNiSi | 800 | 0.3 | 1.38 | 2.2 | 4.7 | 3.8 | 0.81 | 5.5 |
| Example | 120 | CuNiSi | 850 | 0.3 | 1.89 | 2.9 | 6.0 | 5.1 | 0.85 | 19 |

TABLE 7-continued

| | No. | Alloy species | Solid solution temperature (° C.) | Friction coefficient μ | Shear coefficient ϕ | Equivalent strain ϵ | Intensity ratio: I(111)/I(200) (after rolling) | Intensity ratio: I(111)/I(200) (after conversion to solid solution) | Intensity ratio maintenance factor (after conversion to solid solution/after rolling) | Average grain size (μm) |
|---|---|---|---|---|---|---|---|---|---|---|
| Comparative example | 1010 | CuBe | 700 | 0.12 | — | 1.5 | 3.8 | 1.8 | 0.47 | 5 |
| Comparative example | 1020 | CuBe | 750 | 0.12 | — | 1.2 | 3.7 | 1.7 | 0.46 | 8 |
| Comparative example | 1030 | CuBe | 800 | 0.12 | — | 1.2 | 3.5 | 1.7 | 0.48 | 16 |
| Comparative example | 1040 | CuBe | 850 | 0.12 | — | 1.6 | 4.2 | 1.7 | 0.40 | 35 |
| Comparative example | 1050 | CuBe | 800 | 0.12 | — | 0.8 | 1.4 | 0.3 | 0.19 | 17 |
| Comparative example | 1060 | CuTi | 700 | 0.12 | — | 1.6 | 3.2 | 1.3 | 0.40 | 2 |
| Comparative example | 1070 | CuTi | 750 | 0.12 | — | 1.2 | 2.7 | 1.0 | 0.37 | 8 |
| Comparative example | 1080 | CuTi | 800 | 0.12 | — | 0.8 | 2.4 | 1.1 | 0.46 | 19 |
| Comparative example | 1090 | CuTi | 850 | 0.12 | — | 1.6 | 1.8 | 1.1 | 0.61 | 35 |
| Comparative example | 1100 | CuNiSi | 700 | 0.12 | — | 1.2 | 1.1 | 0.2 | 0.19 | 1.5 |
| Comparative example | 1110 | CuNiSi | 750 | 0.12 | — | 1.4 | 1.2 | 0.1 | 0.08 | 3 |
| Comparative example | 1120 | CuNiSi | 800 | 0.12 | — | 0.8 | 1.8 | 0.08 | 0.04 | 6 |
| Comparative example | 1130 | CuNiSi | 850 | 0.12 | — | 0.8 | 1.7 | 0.09 | 0.05 | 21 |

As is clear from Table 7, the test materials 10 to 120 of Example had average X-ray diffraction intensity ratios of 5.0 and 4.1 before the solution treatment and after the solution treatment, respectively, and therefore, even after the solid solution treatment, 81% of X-ray diffraction intensity ratio before the solution treatment was maintained in average. On the other hand, it was made clear that the test materials 1010 to 1130 of Comparative example had average X-ray diffraction intensity ratios of merely 2.5 and 0.9 before the solution treatment and after the solution treatment, respectively, and therefore, after the solid solution treatment, merely 32% of X-ray diffraction intensity ratio before the solution treatment was maintained. Furthermore, in a manner similar to that in Example 1, the copper base rolled alloy was etched up to the vicinity of the center of the sheet thickness so as to expose a surface parallel to the rolled surface, and the X-ray diffraction intensity ratio was measured from the direction of the rolled surface. As a result, it was made clear that the <111>//ND texture was developed in the sheet thickness direction.

As described above, it was made clear that according to the manufacturing method for the copper base rolled alloy of the present Example, a copper base rolled alloy in which a predetermined X-ray diffraction intensity ratio gained after the rolling and before the solution treatment was able to be almost maintained even after the solution treatment was obtained and that since a high X-ray diffraction intensity ratio was obtained by non-lubricating rolling before the solution treatment, a copper base rolled alloy in which the high X-ray diffraction intensity ratio was maintained after the solution treatment was obtained. And at the same time, it was made clear that a copper base rolled alloy in which the <111>//ND texture having the above-described X-ray diffraction intensity ratio was developed in the sheet thickness direction was obtained.

Example 4

Evaluation of Characteristics

Among the test materials obtained in Example 3, regarding the test materials 30, 70, and 120 of Example, the age hardening treatment condition was variously changed as shown in Table 8 and, thereby, test materials 30a to 3j, test materials 70a to 70h, and test materials 120a to 120g were prepared. Likewise, regarding the test materials 1030, 1080, and 1130 of Comparative example, the age hardening treatment condition was variously changed as shown in Table 9 and, thereby, test materials 1030a to 1030i, test materials 1080a to 1080h, and test materials 1130a to 1130g were prepared. Regarding these various test materials, the tensile strength and the bend factor R/t were measured as in Example 2. The results with respect to the test materials of Examples and Comparative examples are shown in Table 8 and Table 9.

TABLE 8

| | No. | | Alloy species | Solid solution temperature (° C.) | Friction coefficient μ | Shear coefficient φ | Equivalent strain ε | Intensity ratio: I(111)/I(200) (after rolling) | Intensity ratio: I(111)/I(200) (after conversion to solid solution) | Intensity ratio maintenance factor (after conversion to solid solution/after rolling) | Age hardening treatment | Tensile strength (N/m2) | R/t |
|---|---|---|---|---|---|---|---|---|---|---|---|---|---|
| Example | 30 | a | CuBe | 800 | 0.3 | 1.21 | 2.7 | 5.3 | 4.3 | 0.81 | 300° C.~ | 680 | 0.0 |
| Example | 30 | b | CuBe | 800 | 0.3 | 1.21 | 2.7 | 5.3 | 4.3 | 0.81 | 340° C., | 766 | 0.0 |
| Example | 30 | c | CuBe | 800 | 0.3 | 1.21 | 2.7 | 5.3 | 4.3 | 0.81 | 20 min~ | 799 | 0.0 |
| Example | 30 | d | CuBe | 800 | 0.3 | 1.21 | 2.7 | 5.3 | 4.3 | 0.81 | 40 min | 850 | 0.2 |
| Example | 30 | e | CuBe | 800 | 0.3 | 1.21 | 2.7 | 5.3 | 4.3 | 0.81 | | 880 | 0.5 |
| Example | 30 | f | CuBe | 800 | 0.3 | 1.21 | 2.7 | 5.3 | 4.3 | 0.81 | | 920 | 0.4 |
| Example | 30 | g | CuBe | 800 | 0.3 | 1.21 | 2.7 | 5.3 | 4.3 | 0.81 | | 1045 | 1.2 |
| Example | 30 | h | CuBe | 800 | 0.3 | 1.21 | 2.7 | 5.3 | 4.3 | 0.81 | | 1020 | 1.2 |
| Example | 30 | i | CuBe | 800 | 0.3 | 1.21 | 2.7 | 5.3 | 4.3 | 0.81 | | 970 | 0.8 |
| Example | 30 | j | CuBe | 800 | 0.3 | 1.21 | 2.7 | 5.3 | 4.3 | 0.81 | | 1120 | 1.5 |
| Example | 70 | a | CuTi | 800 | 0.3 | 2.46 | 3.4 | 6.0 | 5.2 | 0.87 | 400° C.~ | 733 | 0.0 |
| Example | 70 | b | CuTi | 800 | 0.3 | 2.46 | 3.4 | 6.0 | 5.2 | 0.87 | 440° C., | 799 | 0.5 |
| Example | 70 | c | CuTi | 800 | 0.3 | 2.46 | 3.4 | 6.0 | 5.2 | 0.87 | 20 min~ | 850 | 0.8 |
| Example | 70 | d | CuTi | 800 | 0.3 | 2.46 | 3.4 | 6.0 | 5.2 | 0.87 | 40 min | 896 | 1.2 |
| Example | 70 | e | CuTi | 800 | 0.3 | 2.46 | 3.4 | 6.0 | 5.2 | 0.87 | | 941 | 1.0 |
| Example | 70 | f | CuTi | 800 | 0.3 | 2.46 | 3.4 | 6.0 | 5.2 | 0.87 | | 991 | 1.6 |
| Example | 70 | g | CuTi | 800 | 0.3 | 2.46 | 3.4 | 6.0 | 5.2 | 0.87 | | 1011 | 1.7 |
| Example | 70 | h | CuTi | 800 | 0.3 | 2.46 | 3.4 | 6.0 | 5.2 | 0.87 | | 1058 | 2.5 |
| Example | 120 | a | CuNiSi | 850 | 0.3 | 1.89 | 2.9 | 6.0 | 5.1 | 0.85 | 400° C.~ | 619 | 0.0 |
| Example | 120 | b | CuNiSi | 850 | 0.3 | 1.89 | 2.9 | 6.0 | 5.1 | 0.85 | 440° C., | 534 | 0.0 |
| Example | 120 | c | CuNiSi | 850 | 0.3 | 1.89 | 2.9 | 6.0 | 5.1 | 0.85 | 20 min~ | 620 | 0.5 |
| Example | 120 | d | CuNiSi | 850 | 0.3 | 1.89 | 2.9 | 6.0 | 5.1 | 0.85 | 40 min | 674 | 0.6 |
| Example | 120 | e | CuNiSi | 850 | 0.3 | 1.89 | 2.9 | 6.0 | 5.1 | 0.85 | | 751 | 1.3 |
| Example | 120 | f | CuNiSi | 850 | 0.3 | 1.89 | 2.9 | 6.0 | 5.1 | 0.85 | | 815 | 1.7 |
| Example | 120 | g | CuNiSi | 850 | 0.3 | 1.89 | 2.9 | 6.0 | 5.1 | 0.85 | | 915 | 2.4 |

TABLE 9

| | No. | | Alloy species | Solid solution temperature (° C.) | Friction coefficient μ | Shear coefficient φ | Equivalent strain ε | Intensity ratio: I(111)/I(200) (after rolling) | Intensity ratio: I(111)/I(200) (after conversion to solid solution) | Intensity ratio maintenance factor (after conversion to solid solution/after rolling) | Age hardening treatment | Tensile strength (N/m2) | R/t |
|---|---|---|---|---|---|---|---|---|---|---|---|---|---|
| Comparative example | 1030 | a | CuBe | 800 | 0.12 | — | 1.2 | 3.5 | 1.7 | 0.48 | 300° C.~ | 660 | 0.0 |
| Comparative example | 1030 | b | CuBe | 800 | 0.12 | — | 1.2 | 3.5 | 1.7 | 0.48 | 340° C., | 720 | 0.0 |
| Comparative example | 1030 | c | CuBe | 800 | 0.12 | — | 1.2 | 3.5 | 1.7 | 0.48 | 20 min~ | 1033 | 1.7 |
| Comparative example | 1030 | d | CuBe | 800 | 0.12 | — | 1.2 | 3.5 | 1.7 | 0.48 | 40 min | 880 | 1.0 |
| Comparative example | 1030 | e | CuBe | 800 | 0.12 | — | 1.2 | 3.5 | 1.7 | 0.48 | | 790 | 0.5 |
| Comparative example | 1030 | f | CuBe | 800 | 0.12 | — | 1.2 | 3.5 | 1.7 | 0.48 | | 830 | 0.8 |
| Comparative example | 1030 | g | CuBe | 800 | 0.12 | — | 1.2 | 3.5 | 1.7 | 0.48 | | 930 | 1.0 |
| Comparative example | 1030 | h | CuBe | 800 | 0.12 | — | 1.2 | 3.5 | 1.7 | 0.48 | | 963 | 1.5 |
| Comparative example | 1030 | i | CuBe | 800 | 0.12 | — | 1.2 | 3.5 | 1.7 | 0.48 | | 1120 | 2.5 |
| Comparative example | 1080 | a | CuTi | 800 | 0.12 | — | 0.8 | 2.4 | 1.1 | 0.46 | 400° C.~ | 733 | 0.0 |
| Comparative example | 1080 | b | CuTi | 800 | 0.12 | — | 0.8 | 2.4 | 1.1 | 0.46 | 440° C., | 799 | 0.9 |
| Comparative example | 1080 | c | CuTi | 800 | 0.12 | — | 0.8 | 2.4 | 1.1 | 0.46 | 20 min~ | 850 | 1.5 |
| Comparative example | 1080 | d | CuTi | 800 | 0.12 | — | 0.8 | 2.4 | 1.1 | 0.46 | 40 min | 935 | 1.6 |
| Comparative example | 1080 | e | CuTi | 800 | 0.12 | — | 0.8 | 2.4 | 1.1 | 0.46 | | 941 | 1.5 |
| Comparative example | 1080 | f | CuTi | 800 | 0.12 | — | 0.8 | 2.4 | 1.1 | 0.46 | | 958 | 2.2 |
| Comparative example | 1080 | g | CuTi | 800 | 0.12 | — | 0.8 | 2.4 | 1.1 | 0.46 | | 1011 | 2.5 |
| Comparative example | 1080 | h | CuTi | 800 | 0.12 | — | 0.8 | 2.4 | 1.1 | 0.46 | | 1038 | 3.2 |
| Comparative example | 1130 | a | CuNiSi | 850 | 0.12 | — | 0.8 | 1.7 | 0.09 | 0.05 | 400° C.~ | 591 | 0.0 |
| Comparative example | 1130 | b | CuNiSi | 850 | 0.12 | — | 0.8 | 1.7 | 0.09 | 0.05 | 440° C., | 554 | 0.0 |
| Comparative example | 1130 | c | CuNiSi | 850 | 0.12 | — | 0.8 | 1.7 | 0.09 | 0.05 | 20 min~ | 613 | 0.9 |
| Comparative example | 1130 | d | CuNiSi | 850 | 0.12 | — | 0.8 | 1.7 | 0.09 | 0.05 | 40 min | 670 | 1.2 |
| Comparative example | 1130 | e | CuNiSi | 850 | 0.12 | — | 0.8 | 1.7 | 0.09 | 0.05 | | 719 | 2.0 |
| Comparative example | 1130 | f | CuNiSi | 850 | 0.12 | — | 0.8 | 1.7 | 0.09 | 0.05 | | 834 | 2.4 |
| Comparative example | 1130 | g | CuNiSi | 850 | 0.12 | — | 0.8 | 1.7 | 0.09 | 0.05 | | 912 | 3.4 |

As is clear from Table 8 and Table 9, the test materials of Examples had the tensile strength and the bend formability as compared with the test materials of Comparative examples. Consequently, it was made clear that regarding the copper base rolled alloy, the bend formability and the strength were able to be improved by developing the <111>//ND texture.

The present application claims the benefit of the priority from Japanese Patent Application No. 2006-174419 filed on Jun. 23, 2006, the entire contents of which are incorporated herein by reference.

INDUSTRIAL APPLICABILITY

The copper base rolled alloy of the present invention can be used for various electronic components and mechanical components, for example.

The invention claimed is:

1. A manufacturing method for a copper base rolled alloy comprising:

a rolling step of rolling an alloy cast body having a copper base alloy composition containing 0.05 percent by mass or more, and 10 percent by mass or less of at least one element selected from Be, Mg, Al, Si, P, Ti, Cr, Mn, Fe, Co, Ni, Zr and Sn, and not containing P at a concentration more than or equal to the concentration of incidental impurities with shear deformation in such a way that a <111>//ND texture is provided;

a solution treatment step of converting a workpiece, which has been subjected to the rolling step, to a solid solution at 700° C. or higher, and 1,000° C. or lower, and a measuring step of measuring a rolled surface of the copper base rolled alloy using X-ray diffraction, wherein an X-ray diffraction intensity ratio I(111)/I(200) of the rolled surface of the copper base rolled alloy is 2.0 or more.

2. The manufacturing method according to claim 1, wherein regarding the rolling step, rolling is conducted under the rolling condition in which the friction coefficient μ is 0.2 or more and the equivalent strain ϵ represented by the following Formula (1) becomes 1.6 or more $$\bar{\varepsilon} = \frac{2}{\sqrt{3}}\phi \ln\frac{1}{1-r} \tag{1}$$

where $$\phi = \sqrt{1 + \left\{\frac{(1-r)^2}{r(2-r)}\tan\theta\right\}^2} \tag{2}$$

r: rolling reduction rate

θ: apparent shear angle after rolling of an element, which is perpendicular to a sheet surface before rolling, at a predetermined position in a sheet thickness direction ϕ: shear coefficient.

3. The manufacturing method according to claim 2, wherein the shear coefficient ϕ is 1.2 or more, and 2.5 or less.

4. The manufacturing method according to claim 1, wherein the rolling step comprises a step of subjecting the alloy cast body to any one rolling selected from differential speed rolling and different roll diameter rolling.

5. The manufacturing method according to claim 1, wherein the rolling step comprises a step of conducting a differential speed rolling under a condition of rotation speed ratio of 1.2 or more, and 2.0 or less or conducting different roll diameter rolling under a condition satisfying the rotation speed ratio of 1.2 or more and 2.0 or less.

6. The manufacturing method according to claim 1, comprising an age hardening treatment step of subjecting a workpiece, which has been subjected to the solution treatment step, to an age hardening treatment at 200° C. or higher, and 550° C. or lower.

* * * * *